US009361867B2

(12) United States Patent
Filonovich et al.

(10) Patent No.: US 9,361,867 B2
(45) Date of Patent: Jun. 7, 2016

(54) DETACHABLE SHAKER

(75) Inventors: Victor Filonovich, Clifton, NJ (US); Sergio G Bonsignore, Ridgewood, NY (US)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days.

(21) Appl. No.: 14/351,793

(22) PCT Filed: Oct. 12, 2011

(86) PCT No.: PCT/US2011/056029

§ 371 (c)(1), (2), (4) Date: Jun. 4, 2014

(87) PCT Pub. No.: WO2013/055336

PCT Pub. Date: Apr. 18, 2013

(65) Prior Publication Data

US 2014/0318346 A1 Oct. 30, 2014

Related U.S. Application Data

(63) Continuation of application No. 13/272,087, filed on Oct. 12, 2011, now Pat. No. 8,558,097.

(51) Int. Cl.
*G10D 13/06* (2006.01)
*G10D 13/08* (2006.01)

(52) U.S. Cl.
CPC ..... *G10D 13/06* (2013.01); *G10D 13/08* (2013.01)

(58) Field of Classification Search
CPC ..... G10D 13/08; G10D 13/06
See application file for complete search history.

(56) References Cited

U.S. PATENT DOCUMENTS

| | | | | | |
|---|---|---|---|---|---|
| 2,318,460 | A | * | 5/1943 | Brief | 446/419 |
| D139,512 | S | * | 11/1944 | Allen | D21/406 |
| 2,499,483 | A | * | 3/1950 | Foy | A63B 43/00 446/219 |
| 2,584,554 | A | * | 2/1952 | Clayton | 84/170 |
| 2,644,890 | A | * | 7/1953 | Hollihan | 250/462.1 |
| 3,369,598 | A | * | 2/1968 | List | 165/90 |
| 3,460,830 | A | * | 8/1969 | Barlow et al. | 273/440 |
| 4,165,671 | A | * | 8/1979 | De Bose | 84/402 |
| 4,179,973 | A | * | 12/1979 | White | 84/402 |
| 4,306,485 | A | * | 12/1981 | Rudkin | 84/402 |
| 4,901,617 | A | * | 2/1990 | Malone et al. | 84/402 |
| 6,146,236 | A | * | 11/2000 | Kay | 446/419 |
| 6,255,572 | B1 | * | 7/2001 | Moghaddam et al. | 84/402 |
| 6,288,314 | B1 | * | 9/2001 | Cohen et al. | 84/402 |
| 6,512,169 | B1 | * | 1/2003 | Santini | 84/402 |
| 6,620,991 | B1 | * | 9/2003 | Honiball | 84/402 |
| 6,682,393 | B1 | * | 1/2004 | Puett, III | 446/418 |
| 6,858,787 | B1 | * | 2/2005 | de Vries | 84/402 |
| D511,354 | S | * | 11/2005 | Cohen | D17/22 |
| 7,045,695 | B1 | * | 5/2006 | Cohen | G10K 3/00 446/419 |

(Continued)

*Primary Examiner* — Robert W Horn
(74) *Attorney, Agent, or Firm* — Koppel, Patrick, Heybl & Philpott

(57) ABSTRACT

A hand-held percussive shaker assembly comprising two identical shakers capable of producing different percussive sounds and rhythms in a single assembly is disclosed. The shakers are detachably connected by an integrally formed lock assembly. The shakers may be played as a single assembly or detached and played individually. Each shaker comprises one or more bottles filled with a striker material. Each bottle isolates its striker material from the striker material in other bottles and from any other part of the shaker. The shakers may produce the same or different tones when the shaker assembly is moved.

12 Claims, 6 Drawing Sheets

(56) References Cited

U.S. PATENT DOCUMENTS

| | | | | |
|---|---|---|---|---|
| 7,169,994 | B1 * | 1/2007 | Payerl | 84/402 |
| 7,534,948 | B2 * | 5/2009 | Rice | 84/404 |
| 7,910,816 | B2 * | 3/2011 | Glowacki | 84/410 |
| 8,558,097 | B2 * | 10/2013 | Krol et al. | 84/402 |
| 2004/0147201 | A1 * | 7/2004 | Cohen | 446/419 |
| 2011/0259173 | A1 * | 10/2011 | Bettinelli | 84/402 |
| 2015/0114204 | A1 * | 4/2015 | Lochen | 84/402 |

* cited by examiner

DETACHABLE SHAKER

BACKGROUND

Percussion musical instruments capable of creating a rhythm are known in the art. Shakers are one type of percussion instrument capable of generating a rhythmic pattern of sound by moving the shaker back and forth. Prior art shakers typically comprise a striker material freely disposed in an enclosed shaker body. Although a percussionist may obtain different sound patterns while operating such a shaker, it is difficult for the percussionist to produce different sounds and different rhythms using a single shaker.

Dual shakers assemblies that produce multiple sounds are also known in the art. Such instruments comprise multiple shakers fixedly connected by a separate connecting member or multiple shakers integrally formed together as a single unit. Such instruments may also comprise individual shakers detachably connected by a separate connecting member, such as a plastic clip or a rubber band. The LP Softshake manufactured by Latin Percussion of Garfield, N.J. is an example of such a shaker.

SUMMARY OF THE INVENTION

The present invention relates to a hand-held musical shaker assembly comprising an integrally formed lock assembly that detachably connects two shakers. The shakers can be played individually or as a single assembly. As a single assembly, the shaker assembly is capable of producing different percussion sounds and different rhythms.

In a preferred embodiment, the shaker assembly comprises a first enclosure, the first enclosure comprising a first sound producing material; a second enclosure, the second enclosure comprising a second sound producing material; a center assembly, the center assembly fixedly connected to the first enclosure and the second enclosure; and a lock assembly, the lock assembly integrally formed in the center assembly. The first sound producing material and the second sound producing material produce a same tone or a different tone. The center assembly further comprises a first member; a second member; a screw, the screw fixedly connecting the first member to the second member. The first member comprises a first tab; the second member comprises a second tab; the first enclosure comprises a first hole and a second hole; the first tab engageable with the first hole; and the second tab engageable with the second hole.

In another preferred embodiment, the shaker assembly comprises a first shaker, the first shaker comprising a first sound producing material; a second shaker, the second shaker comprising a second sound producing material; a first lock assembly integrally formed in the first shaker; and a second lock assembly integrally formed in the second shaker; the first lock assembly detachably connected to the second lock assembly.

In another preferred embodiment, the first lock assembly comprises a lip, the lip insertable in a groove of the second lock assembly, the lip further engageable with a plate of the second lock assembly such that the shaker assembly is held in a closed position.

In another preferred embodiment, the first lock assembly comprises a snap, the snap engageable with a hole of the second lock assembly such that the shaker assembly is held in a closed position.

In another preferred embodiment, the first lock assembly comprises a ridge, the ridge engageable with a lip of the second lock assembly such that the shaker assembly is held in a closed position.

In another preferred embodiment, the shaker assembly comprises a substantially hollow enclosure, the enclosure containing a sound producing material; and a lock assembly, the lock assembly integrally formed in an outer wall of the enclosure.

DESCRIPTION OF THE DRAWINGS

Like reference symbols in the various drawings indicate like elements.

DETAILED DESCRIPTION

The present invention generally relates to a hand-held musical shaker assembly that produces a variety of different sounds and different rhythms and that comprises an integrally formed lock assembly that allows the user to selectively detach the shaker assembly into two individual shakers. A user may play the shakers individually or as a single assembly. Further explanation and variations of the present invention are described below with reference to FIGS. 1-6.

Figure 1:
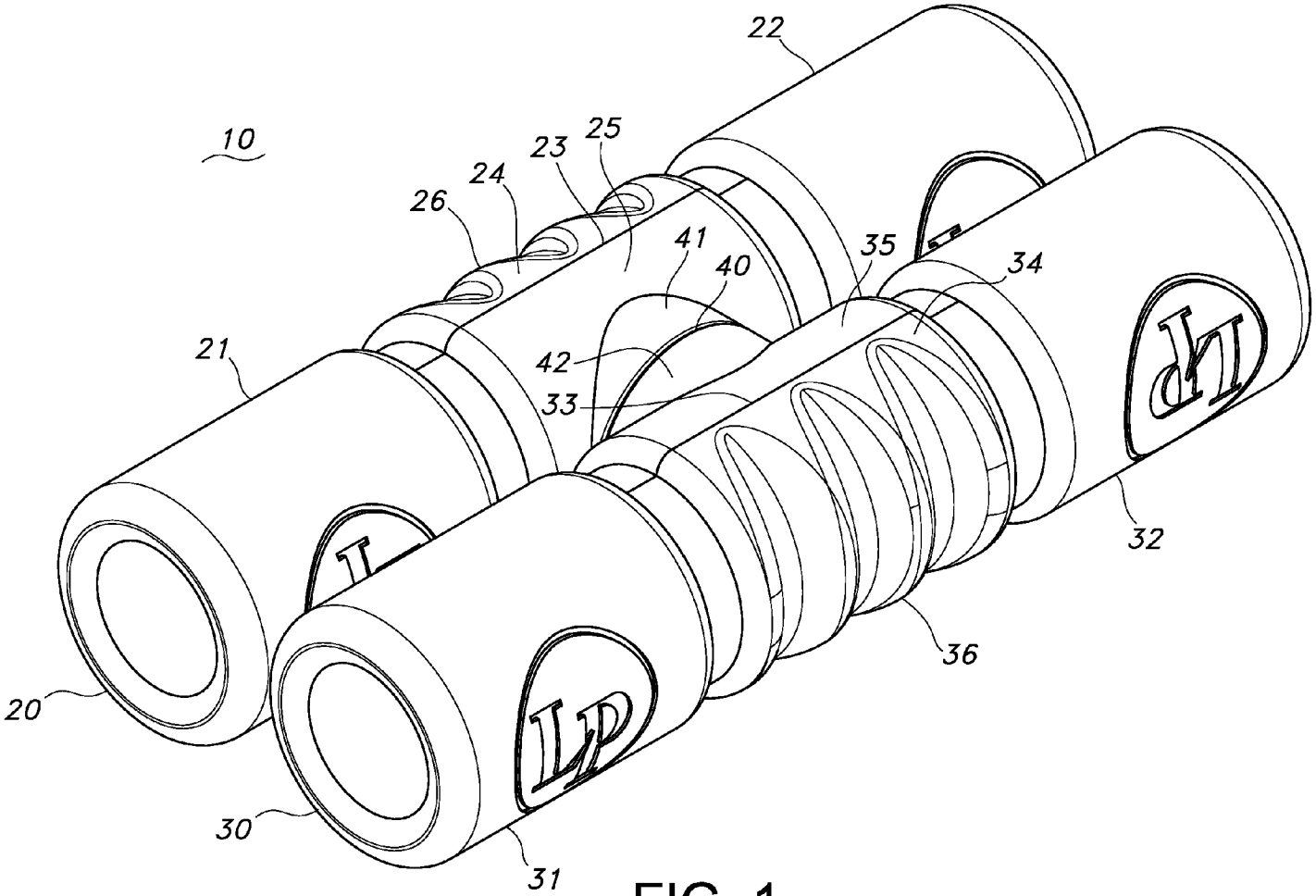
FIG. 1 is an illustrative external view of a detachable shaker in a closed position according to one embodiment of the present invention.

FIG. 1 is an illustrative external view of a detachable shaker in a closed position according to one embodiment of the present invention. The detachable shaker assembly 10 comprises two substantially identical independent shakers 20 and 30. Shakers 20 and 30 comprise a center assembly 23, 33, which comprises a pair of semi-cylindrical members 24, 25 and 34, 35. The center assembly is substantially cylindrical. A portion of an outer surface of the center assembly is grooved to provide grips 26, 36 for a user. Shakers 20 and 30 comprise two bottles 21, 22 and 31, 32 respectively, one at each end of center assembly 23, 33. Each bottle is a substantially hollow chamber (enclosure) that is preferably filled with a striker (sound producing medium) material as discussed below.

Shaker assembly 10 is preferably made of plastic. In such embodiments, center assemblies 23, 33 are preferably formed by injection molding or another suitable manufacturing process. Bottles 21, 22, 31, and 32 are preferably formed by blow molding or another suitable manufacturing process.

Although shaker assembly 10 is preferably made of plastic, any of a variety of materials can be used, such as, for example, wood, metal, or a combination of different materials. Different materials may be used to produce different sounds. Also, although a substantially cylindrical shaker is shown, the external shape of the shaker may vary. For example, the shaker may be triangular, cubical, rectangular, pentagonal, hexagonal, octagonal, or spherical. Further, the shaker walls may be concave or convex depending on the desired appearance and/or the desired sound.

In a preferred embodiment, a striker material is disposed in at least one of bottles 21, 31, 22, 32. The striker material is preferably freely movable within the bottle such that it may strike the inner walls of the bottle when shaker assembly 10 is moved. Each bottle isolates the striker material from the other parts of the shaker and from the striker material disposed in other bottles. By having separate striker material in separate shakers, shakers 20 and 30 are capable of producing different and independent sounds. For example, bottles 21 and 22 may be filled with a striker material that produces a first sound. At the same time, bottles 31 and 32 may be filled the same striker material such that shakers 20 and 30 produce the same sound. Or, bottles 31 and 32 may be filled with a different striker material that produces a second sound. The sounds may differ, for example, in volume or in tone.

The striker material may be of any variety of shapes, sizes, and materials. The striker material may, however, be a cylinder, a cube, a rectangular prism, or irregular shapes like chips or shad. In addition, the striker material may be formed from a variety of different materials. For example, the striker may be made from metal, plastic, or wood. By varying the size, shape, quantities, and composition of the striker material, shakers with different sounds may be produced.

Shakers 20 and 30 are detachably connected at their respective center assemblies by a lock assembly 40. As shown in FIG. 1, lock assembly 40 is in the closed position and shakers 20 and 30 are substantially parallel to each other. As such, a user can play shakers 20 and 30 as a single instrument.

Figure 2:
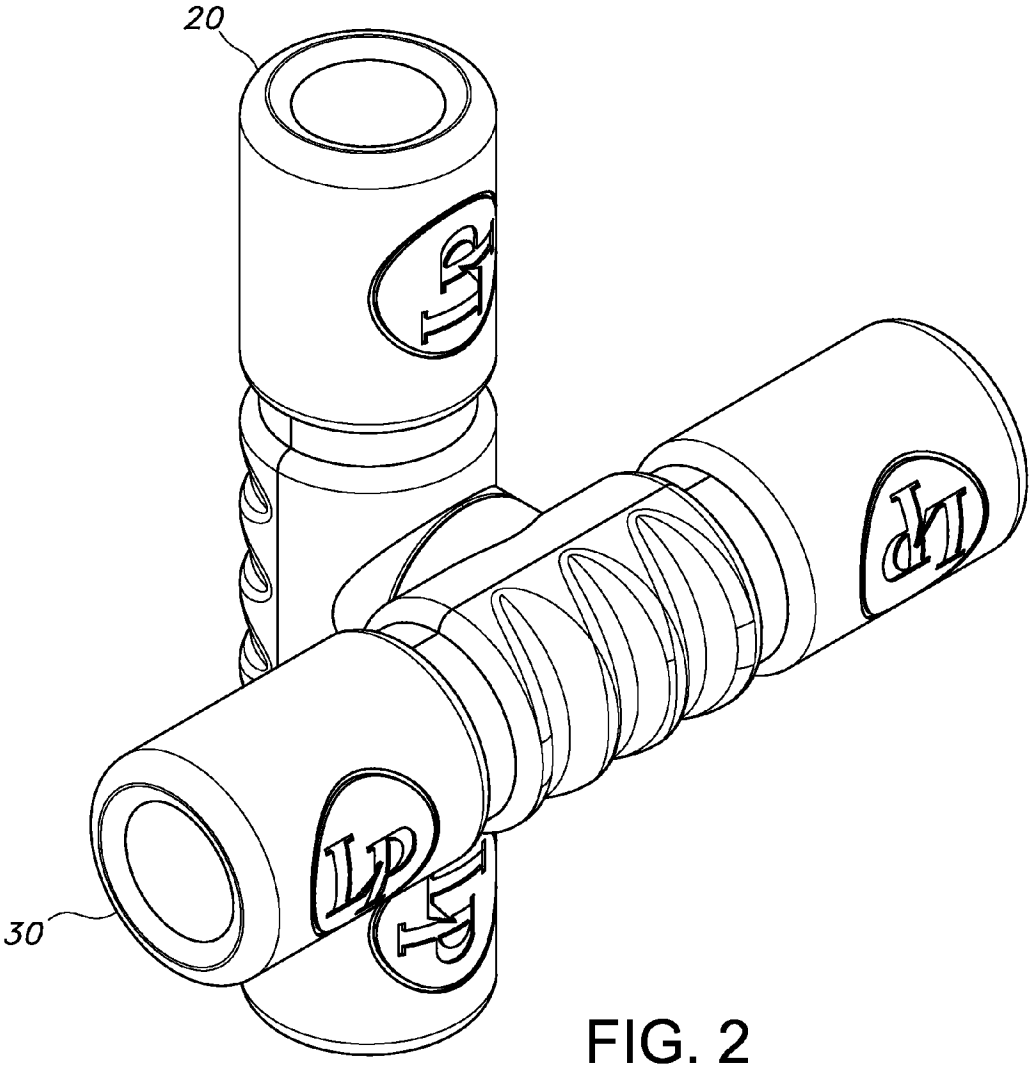
FIG. 2 is an illustrative view of a detachable shaker in an open position according to one embodiment of the present invention.

FIG. 2 is an illustrative view of the shaker assembly in an open position according to one embodiment of the present invention. As shown, shakers 20 and 30 are rotated 90 degrees from the closed position and are substantially perpendicular to each other. In the open position, shakers 20 and 30 may be detached from each other and played as two independent shakers.

Figure 3:
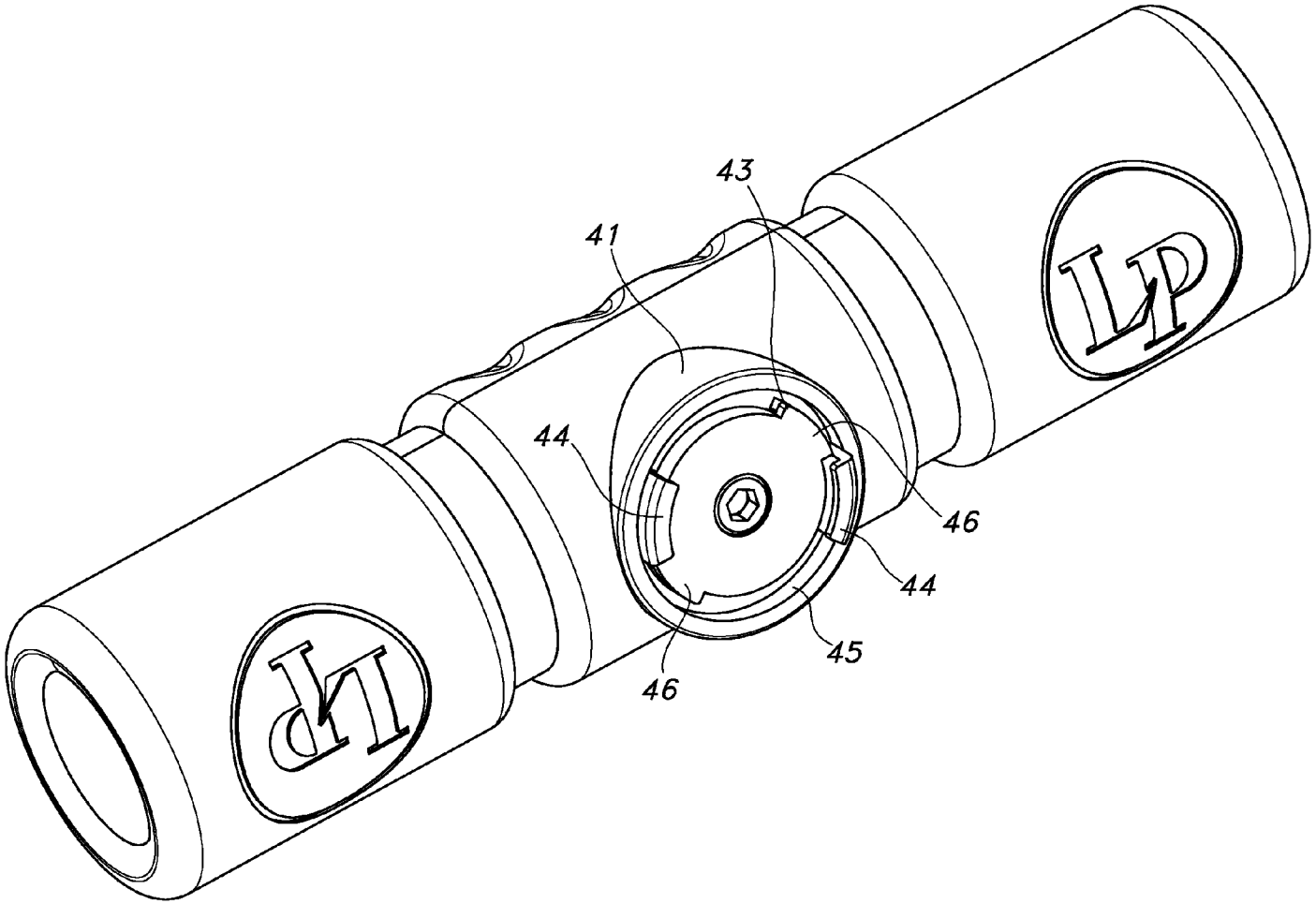
FIG. 3 is an illustrative view of a single shaker of a detachable shaker assembly according to one embodiment of the present invention.

FIG. 3 is an illustrative view of a single detached shaker of a detachable shaker assembly according to one embodiment of the present invention. FIG. 3 shows an internal view of a first lock member 41 of lock assembly 40. First lock member 41 and a second lock member 42 are substantially identical and mate as shown in FIG. 1. Each lock member comprises a substantially circular plate 43. The plate 43 has a pair of opposing flanges 46 integrally formed along a portion of its circumference. A groove 45 is formed between plate 43 and the inner walls of first lock member 41. A pair of opposing L-shaped lips 44 are integrally formed along the inner wall of lock members 41, 42. Alternatively, lock members 41, 42 may only have a single L-shaped lip 44. In order to lock the shaker assembly, lips 44 of first lock member 41 are inserted within the grooves of second lock member 42 and vice versa. Shakers 20 and 30 are rotated 90 degrees such that lips 44 are held under flanges 46. As such, shakers 20 and 30 interlock and are held in the closed position.

Figure 4:
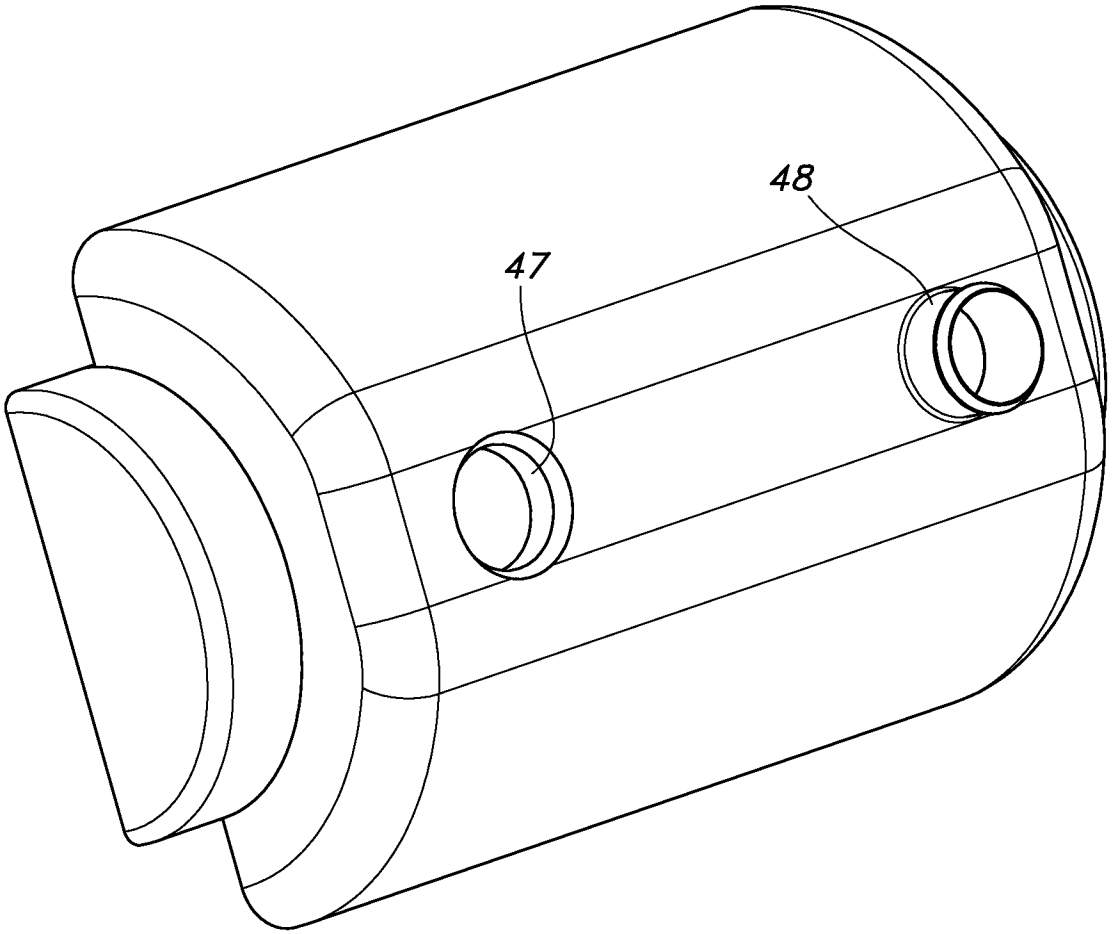
FIG. 4 is an illustrative view of the center assembly according to a further embodiment of the lock assembly of the present invention.

FIG. 4 is an illustrative view of the center assembly according to a further embodiment of the lock assembly of the present invention. Each lock member comprises a hole 47 and a snap 48. The hole of shaker 20 engages with the snap of shaker 30, and vice versa. As such, shakers 20 and 30 may be snapped together and held in the closed position.

Figure 5:
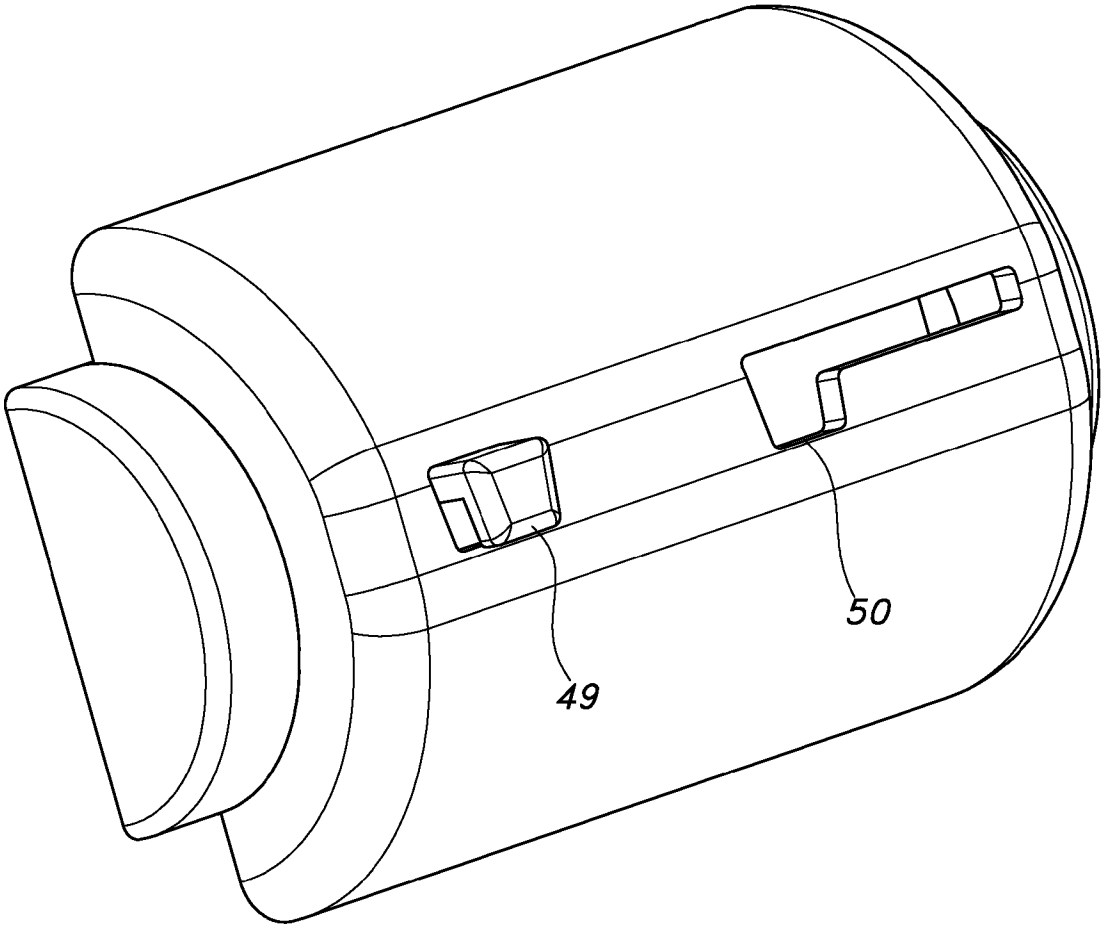
FIG. 5 is an illustrative view of the center assembly according to a further embodiment of the lock assembly of the present invention.

FIG. 5 is an illustrative view of the center assembly according to a further embodiment of the lock assembly of the present invention. Each lock member comprises an L-shaped lip 49 and an L-shaped ridge 50. The ridge of shaker 20 may be slid under the lip of shaker 30, and vice versa. As such, shakers 20 and 30 may be slid together and held in the closed position.

Figure 6:
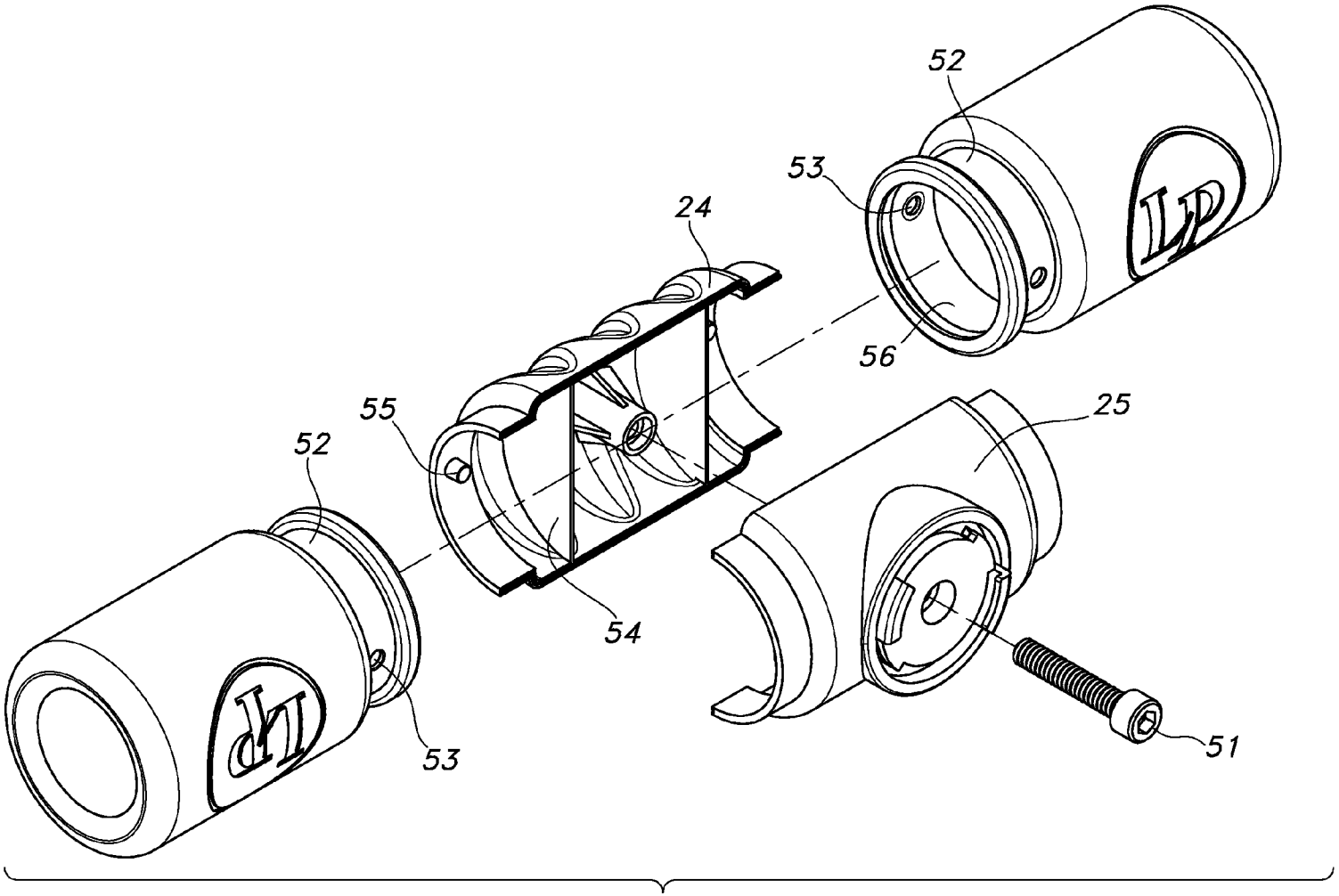
FIG. 6 is an illustrative exploded view of a single shaker of a detachable shaker assembly according to one embodiment of the present invention.

FIG. 6 is an illustrative exploded view of a single shaker of an interchangeable shaker assembly according to one embodiment of the present invention. The center assembly comprises to two substantially symmetric, semi-cylindrical members 24, 25. Members 24, 25 are preferably held together by a screw 51. Each end of members 24, 25 comprises a tab 55 that engages with a hole 53 formed in a bottleneck 52 when the shaker is assembled. Each bottle preferably has two holes so that each center member may be connected to the bottle. Each end of center members 24, 25 also comprises a plate 54. When the center assembly is fastened together by screw 51, the plates at each end of the center members form a base. The base blocks an open end 56 of the bottle when the bottle is connected to the center assembly. As such, the striker material in the bottle is isolated from the rest of the shaker assembly.

One advantageous feature of the present invention is that the shaker assembly can be selectively detached by the user. As such, a user has the option of playing the shakers individually, or as a single unit. The lock allows the user to easily detach the individual shakers. Because the lock is integrated into the body of the shaker assembly, no separate securing means is required.

Another advantageous feature of the present invention is that the shaker assembly may produce a different sounds and rhythms in a single assembly. For example, the individual shakers may be filled with different sound producing material such that the shaker assembly produces different tones.

A number of embodiments of the invention have been described. Nevertheless, it will be understood that various modifications may be made without departing from the scope of the invention. Accordingly, other embodiments are contemplated within the scope of the following claims.

We claim:

1. A hand-held percussive shaker instrument comprising:

a first enclosure, the first enclosure comprising a first sound producing material;

a second enclosure, the second enclosure comprising a second sound producing material;

a center assembly, the center assembly fixedly connected to the first enclosure and the second enclosure; and a lock assembly, the lock assembly integrally formed in the center assembly;

wherein said center assembly divides said lock assembly from said first enclosure and said second enclosure.

2. The instrument of claim 1 wherein the first sound producing material and the second sound producing material produce a different tone.

3. The instrument of claim 1 wherein the first sound producing materials and the second sound producing material produce a same tone.

4. The instrument of claim 1 wherein the center assembly comprises:

a first member;

a second member;

a screw, the screw fixedly connecting the first member to the second member.

5. The instrument of claim 4 wherein the first member comprises a first tab;

the second member comprises a second tab;

the first enclosure comprises a first hole and a second hole;

the first tab engaged with the first hole; and the second tab engaged with the second hole.

6. A hand-held percussive shaker assembly comprising:

a first shaker, the first shaker comprising a first sound producing material;

a second shaker, the second shaker comprising a second sound producing material;

a first lock assembly integrally formed in the first shaker;

a second lock assembly integrally formed in the second shaker; and the first lock assembly detachably connected to the second lock assembly;

wherein said first shaker comprises one or more enclosures divided from said first lock assembly.

7. The percussive shaker assembly of claim 6 wherein the first sound producing material and the second sound producing material produce a same tone.

8. The percussive shaker assembly of claim 7 wherein the first sound producing material and the second sound producing material produce a different tone.

9. The percussive shaker assembly of claim 6 wherein the first lock assembly comprises:

a lip, the lip insertable in a groove of the second lock assembly, the lip further engageable by a plate of the second lock assembly such that the shaker assembly is held in a closed position.

10. The percussive shaker assembly of claim 6 wherein the first lock assembly comprises:

a snap, the snap engageable with a hole of the second lock assembly such that the shaker assembly is held in a closed position.

11. The percussive shaker assembly of claim 6 wherein the first lock assembly comprises:

a ridge, the ridge engageable with a lip of the second lock assembly such that the shaker assembly is held in a closed position.

12. A hand-held percussive shaker instrument comprising:

a substantially hollow enclosure, the enclosure containing a sound producing material; and a lock assembly, the lock assembly integrally formed in an outer wall of the enclosure;

wherein said lock assembly is divided from said substantially hollow enclosure.

* * * * *